US012310456B2

(12) United States Patent
Cho

(10) Patent No.: US 12,310,456 B2
(45) Date of Patent: May 27, 2025

(54) METHOD FOR FORMING SHOESTRING TYING DEVICES WHICH ARE VERTICALLY SEPARATED

(71) Applicant: Yong Ho Cho, Goyang-si (KR)

(72) Inventor: Yong Ho Cho, Goyang-si (KR)

( * ) Notice: Subject to any disclaimer, the term of this patent is extended or adjusted under 35 U.S.C. 154(b) by 0 days.

(21) Appl. No.: 18/565,556

(22) PCT Filed: Jun. 3, 2022

(86) PCT No.: PCT/KR2022/007958
§ 371 (c)(1),
(2) Date: Nov. 30, 2023

(87) PCT Pub. No.: WO2022/260377
PCT Pub. Date: Dec. 15, 2022

(65) Prior Publication Data

US 2024/0365929 A1 Nov. 7, 2024

(30) Foreign Application Priority Data

Jun. 8, 2021 (KR) ..... 10-2021-0074180

(51) Int. Cl.

| | |
|---|---|
| ***A43C 1/04*** | (2006.01) |
| ***A43C 1/00*** | (2006.01) |
| ***A43C 5/00*** | (2006.01) |
| *A43D 100/02* | (2006.01) |

(52) U.S. Cl.
CPC ..... *A43C 1/00* (2013.01); *A43C 1/04* (2013.01); *A43C 5/00* (2013.01); *A43D 100/02* (2013.01)

(58) Field of Classification Search
CPC ..... A43C 1/04; A43C 5/00; A43D 100/02
See application file for complete search history.

(56) References Cited

U.S. PATENT DOCUMENTS

| | | | |
|---|---|---|---|
| 2005/0126043 | A1 | 6/2005 | Reagan et al. |
| 2006/0185193 | A1 | 8/2006 | Pellegrini |
| 2009/0038128 | A1 | 2/2009 | Cho |
| 2011/0308115 | A1 | 12/2011 | Le et al. |

FOREIGN PATENT DOCUMENTS

| | | | |
|---|---|---|---|
| JP | 06-013504 | U | 2/1994 |
| JP | 3115773 | U | 11/2005 |
| KR | 10-0733024 | B1 | 7/2007 |

OTHER PUBLICATIONS

International Search Report for PCT/KR2022/007958 mailed Oct. 5, 2022 from Korean Intellectual Property Office.

*Primary Examiner* — Jermie E Cozart
(74) *Attorney, Agent, or Firm* — Revolution IP, PLLC

(57) ABSTRACT

The present invention relates to shoes having shoestrings that are tied all at once, and to a method for forming shoestring tying devices, the method allowing the fastening portions of pull string loop positioned at the upper left and right sides of the shoes to be vertically separated to allow tying.

3 Claims, 5 Drawing Sheets

METHOD FOR FORMING SHOESTRING TYING DEVICES WHICH ARE VERTICALLY SEPARATED

TECHNICAL FIELD

The present disclosure relates to a shoe for tying shoestring, and more particularly, to a method of forming shoestring tying devices that separates the upper and lower pairs of fasteners on the left and right sides of a shoe and fastens them comfortably and safely in the shoe that can be easily put on and taken off by pulling or releasing them at once.

BACKGROUND ART

Generally, for shoes, a user starts threading the strings from the bottom left and right eyelets, inserting them one at a time in the shape of an X, and continuing all the way to the top. After inserting the string using this method, it is finished with a ribbon-type knot at the top. When wearing these shoes, it is true that the procedure is cumbersome because it has to be tightened and tied the strings one by one.

Accordingly, it became necessary to tie the strings more easily, and in response to this, the applicant applied as a legal representative for Korean Patent No. 0445965, "Shoes that tie the shoelaces at once and method of tying shoelaces" have been proposed as an alternative.

More specifically, as shown in FIG. 7, the string begins to be inserted from 6th eyelets (16*a*, 16*b*), skips one space at a time to the upper end with one space and the string is inserted into 4th eyelets (14*a*, 14*b*) to be crossed. In the same way, after the string is inserted to the upper end and a pair of right and left string loops (19*a*, 19*b*) are formed, then the string is again inserted into empty 3rd eyelets (13*a*, 13*b*) and the installation of the string is finished in 5th eyelets (15*a*, 15*b*). Moreover, in the string loops formed in the upper portion, connecting parts (21*a*,21*b*) are adhered to and it completes. Installing the string by skipping one space at a time means that when the string is tightened at the top, the angle of the string passing through each eyelet becomes twice as wide, and the resistance of the string passing through the eyelets is offset by two times compared to the tightening of regular shoe laces, and thus it is easily tightened and loosened.

Although the shoes of the above invention are convenient for the wearer to use, they have several shortcomings. That is, the prior art of the shoe that ties at once is structural, as shown in FIG. 7, when fastening by pulling the 'V' shaped left and right string loops (19*a*, 19*b*) where the fastening portion is fixed at the top of the instep of the shoe, the pulled positions intersect, and thus the string made up of four strands overlap each other as shown in FIG. 7, in other words, the string is twisted and bunched together, so there is a problem that the wearer may feel uncomfortable due to uneven pressure, and the overall arrangement of the string in the shoe may be unbalanced.

Moreover, in FIG. 7, if the shoes are worn by pulling the connecting parts (21*a*, 21*b*) adhering to the right and left string loops (19*a*, 19*b*), the attachment position of the left and right connecting parts (21*a*, 21*b*) are on the same line and overlap depending on the condition of the wearer's feet when the connecting parts (21*a*, 21*b*) are pulled to the back of the shoe.

DISCLOSURE

Technical Problem

Thus, an object of the present invention is to provide shoes that distribute the pressure of the string loops on the top of the foot so that users can wear the shoes more comfortably and to provide a method of forming the shoestring tying devices which solves the problem that the connecting part adhering to the draw strand string loops, because the positions of the string loops formed at the top of the shoe overlap or are twisted, there is unbalanced pressure on the ankle and aesthetics are unsatisfactory.

Technical Solution

The present invention provides a method of forming shoestring tying devices in shoes which can be attached crosswise with a pair of pull string loops on the upper left and right sides of the shoe neck and are easy to wear as the shoes can be fastened or released by pulling the shoestring tying devices, the method comprising; installing eyelets so that the pull string loops can be separated from each other up and down by omitting one eyelet between a second eyelet and a third eyelet located on the left upper and one eyelet above a first eyelet located on the right upper, forming a pair of connecting portions made of the adhesive and removable material (Velcro) to the top of the left and right sides of the shoe, inserting the shoestring into the eyelets so that the left and right pull string loops formed at the top are separated from each other up and down, and inserting the shoestring crosswise into empty lower eyelets after fastening portions are fastened to the pull string loops.

Advantageous Effects

The present invention is effective for that the pull string loops are separated into top and bottom so the pressure of the string on the ankle is spread out and tightened by the distributed four strand string when wearing shoes, the four strand string are held horizontally without bunching or twisting due to the fastened string loops since they are located side by side, the overall arrangement of shoestrings is neatly formed, and the fastening portions on the back of the shoes do not overlap when the wearer puts the shoes on.

BEST MODE OF THE INVENTION

The present invention is described in detail with reference to attached drawings as follows.

Figure 2:
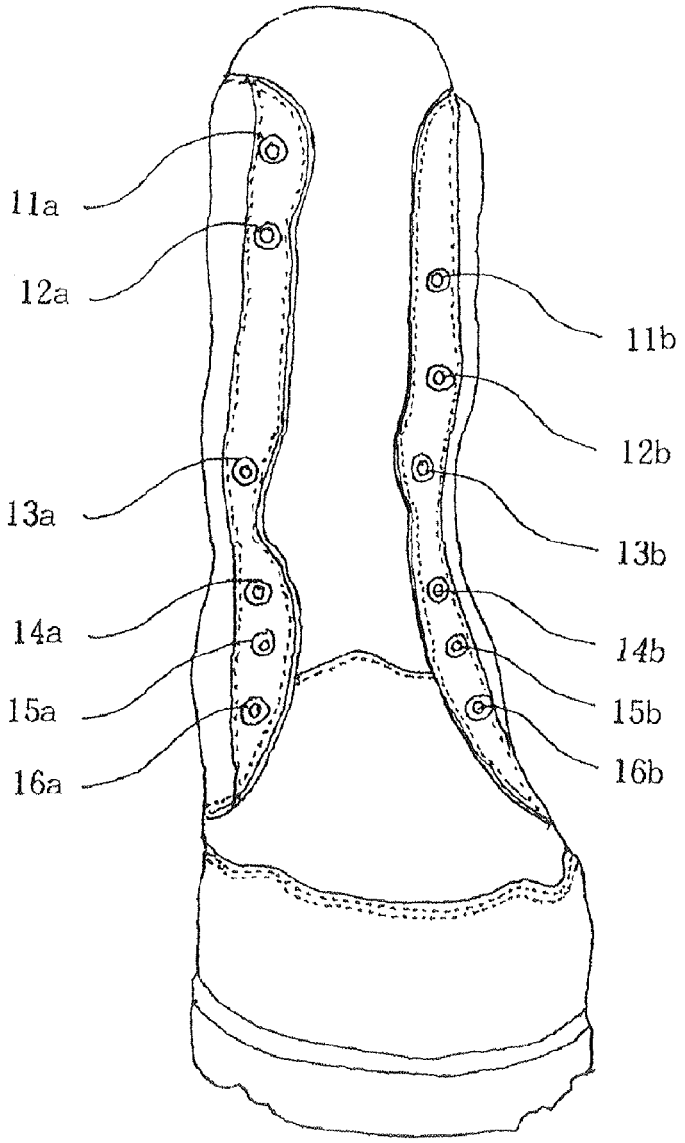
FIG. 2 is a structural diagram of the perforated eyelet used in the present invention.

As shown in FIG. 2 showing the installation of eyelets located on the left and right uppers of the shoe, the perforated eyelets are installed symmetrically at regular intervals on the left upper (16*a*-13*a*) and the right upper (16*b*-13*b*) of the shoe, the left eyelet (12*a*, 11*a*) and right eyelets (12*b*, 11*b*) which form the pull string loops are installed asymmetrically on the top of the left and right uppers, and this occurs when fastening the shoestrings the string loops (19*a*, 19*b*) are clearly separated at the top and bottom fastening.

That is, in order to achieve the above-mentioned purpose, one eyelet is omitted between the eyelets (13*a*, 12*a*) located on the left upper and one eyelet is also omitted above a first eyelet (11*b*) located on the right upper, and it provides the essence of a tying device divided into upper and lower parts which is a feature of the present invention.

MODE OF THE INVENTION

Figure 1:
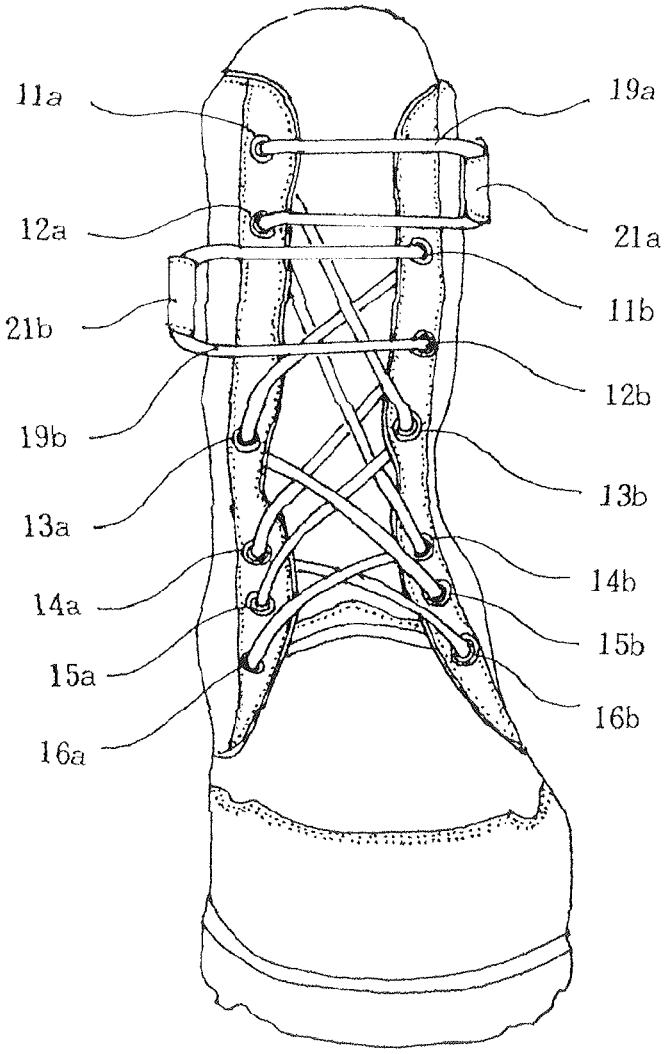
FIG. 1 is a front view of completed arrangement and fastening of shoestring.
Figure 4:
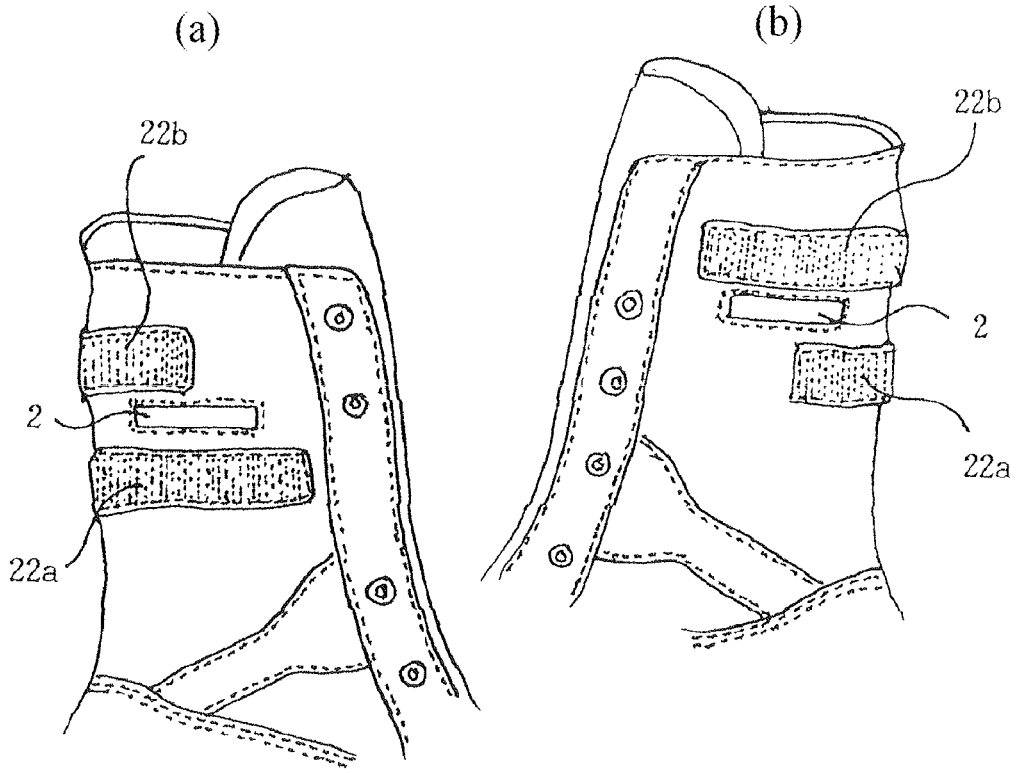
FIGS. 4 to 6 are partial process diagrams used in the present invention.
Figure 5:
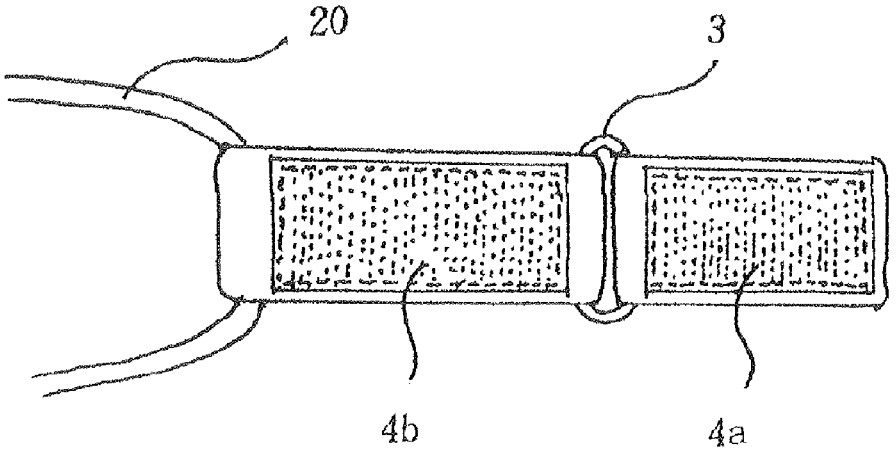
Figure 6:
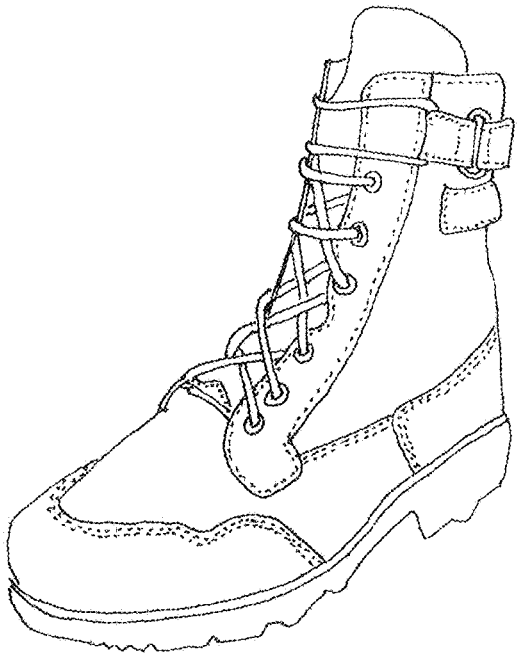
Figure 7:
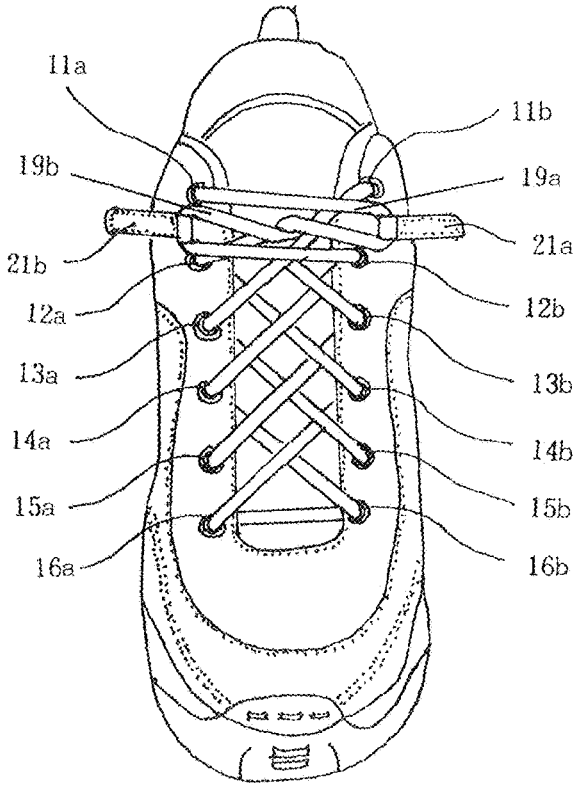
FIG. 7 Prior Art
FIG. 7 is a structural diagram showing the prior art.

FIG. 4 of the next process is a partial view of the connecting portions attached to the top of the left and right uppers of the shoe, and Figured 5 is a detailed partial view of the fastening portions. As shown in (a) of FIG. 4, the connecting portions (22*a*) attached to the top of the left upper next to the shoe ankle and the connecting portions (22*b*) attached to the top of the right upper as shown in (b) are separated up and down, a separation guard (2) is formed between the upper and lower connecting portions separated at regular interval. According to the installation of the upper and lower connecting portions as described above, a wearer pulls the left and right fastening parts (21*a*, 21*b*) as shown in FIG. 1, and attaches them to the horizontally opposite connecting portions so that they do not overlap, and the separation guard (2) protruding between the connecting portions (22*a*, 22*b*) prevents the direction from being misaligned when attaching the fastening portions to the connecting portions. Next, as shown in FIG. 5, the fastening portions ($1^{st}$ part 4*a*, $2^{nd}$ part 4*b*) coupled to the pull string loop are divided into two parts and are integrated by a connecting ring (3) between the two parts.

This structure provides flexibility by bending well when attaching or detaching the fastening portions from the connecting portions (22*a*, 22*b*), in particular when the fastening portions are pulled long according to the condition of the wearer's foot and fastened to the back of the ankle, it naturally bends into a 'U' shape according to the shape of the hind ankle, preventing the attachment range from deviating.

Figure 3:
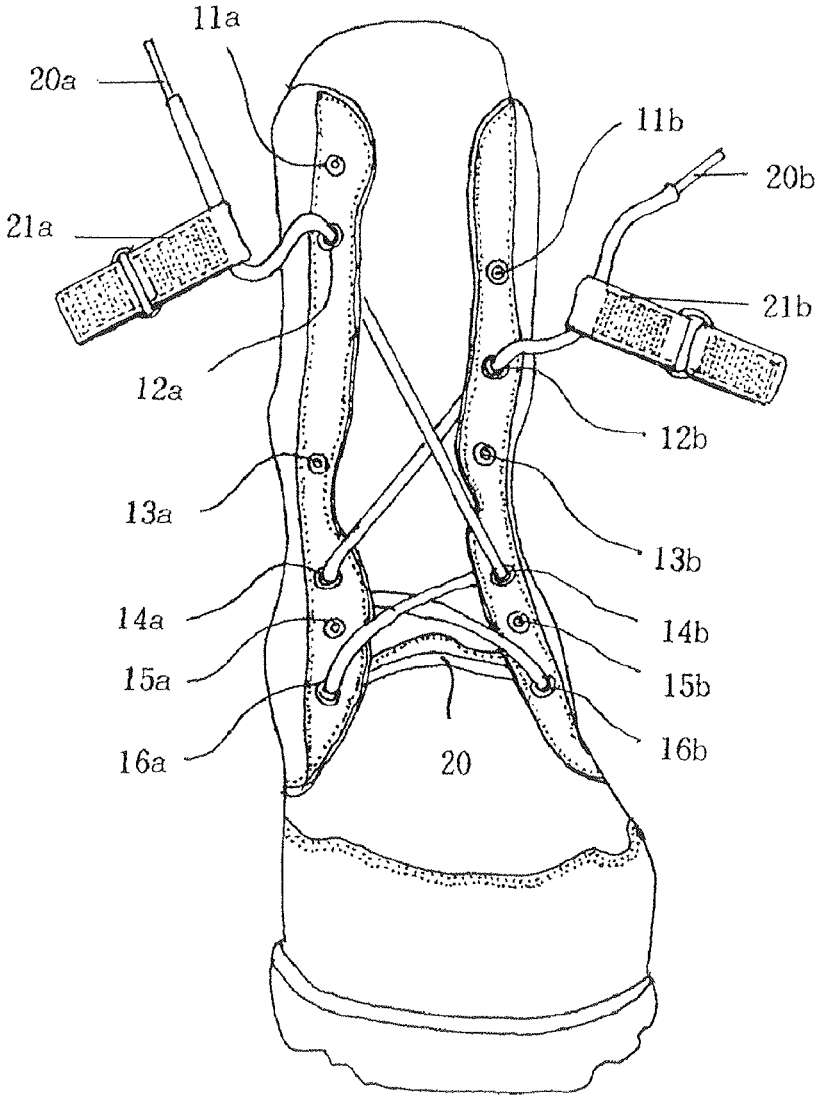
FIG. 3 is a partial view showing the state in which the shoestring according to the present invention is inserted into the eyelet.

After completing the above process, as shown in FIG. 3, the position and name of the eyelets are referred to as the $1^{st}$ eyelet to the $6^{th}$ eyelet (11*a*-16*b*) from top to bottom. Among the eyelets perforated on the left and right around the instep of the shoe, the shoestring (20) is inserted into the $6^{th}$ eyelet (16*a*, 16*b*) at the bottom, and then one space is skipped upward and the shoestring (20) is inserted into the $4^{th}$ eyelet (14*a*, 14*b*) crosswise to form an 'X' shape. For convenience, the ends of the two strands of the shoestring (20) are called string ends (20*a*, 20*b*), respectively.

Next, the string end (20*a*) is inserted into the second eyelet (12*a*) and the string end (20*b*) is inserted into the second eyelet (12*b*), and again the string end (20*a*) is inserted into the fastening portion (21*a*) with the attachment surface made of Velcro facing the front from bottom to top, then the string end (20*a*) is inserted into the uppermost eyelet (11*a*) to create a pull string loop to which the fastening portion is coupled, and in the same way, a pair of the pull string loops connected to the fastening portions are completed by connecting the string end (20*b*) to the fastening portion (21*b*) and inserting the string end (20*b*) into the uppermost eyelet (11*b*). In the next step, the string end (20*a*) passes through the empty third eyelet (13*b*) at the bottom and finishes at the fifth eyelet (15*a*), and the string end (20*b*) passes through the empty lower third eyelet (13*a*) and finishes at the fifth eyelet (15*b*) to complete the installation of the entire string.

The invention claimed is:

1. A method of forming shoestring tying devices in shoes which cross a shoestring into middle eyelets at two intervals and provide 'V' shaped pull string loops at a top to tie the shoestring at once, the method comprising:

positioning first and second eyelets (11*a*, 12*a*) at a left upper and first and second eyelets (11*b*, 12*b*) at a right upper to be asymmetrically separated from each other up and down, by drilling and installing the first and second eyelets (11*a*, 12*a*) at the left upper in which a pull string loop (19*a*) is to be located at a top of the right upper on a right side of a instep cover, and by drilling and installing the first and second eyelets (11*b*, 12*b*) at the right upper in which a pull string loop (19*b*) is to be located at a top of the left upper on a left side of the instep cover, the pull string loop (19*b*) located at the top of the left upper being configured to be located below a horizontal line whose height matches the second eyelet (12*a*) located at the left upper;

installing eyelets (13*a*-16*a*) on a middle lower of the left upper and eyelets (13*b*-16*b*) on a middle lower of the right upper symmetrically to each other;

forming connecting portions to be separated from each other up and down on left and right sides of each shoe neck; and inserting the shoestring into bottom eyelets (16*a*, 16*b*) and threading the shoestring crosswise through to the first eyelets by skipping one eyelet at a time and forming a pair of the pull string loops (19*a*, 19*b*) connected with fastening portions to be separated up and down on the top of the left and right uppers.

2. The method of claim 1, wherein in the forming of a pair of the connecting portions to be separated from each other up and down on left and right sides of each shoe neck, the fastening portions are fastened to the connecting portions using a separation guard between the connecting portions so that pulled fastening portions are not misaligned.

3. The method of claim 1, wherein each of the fastening portions has two fastening parts, and the two fastening parts are connected to each other by a connecting ring between the two fastening parts.

* * * * *